United States Patent [19]

Keeffe et al.

[11] Patent Number: 4,620,130

[45] Date of Patent: Oct. 28, 1986

[54] ELECTRODE ALIGNMENT AND CAPSULE DESIGN FOR SINGLE-ENDED LOW WATTAGE METAL HALIDE LAMPS

[75] Inventors: William M. Keeffe, Rockport; W. Calvin Gungle, Danvers; Harold L. Rothwell, Jr., Rowley; Zeya K. Krasko, Danvers, all of Mass.

[73] Assignee: GTE Products Corporation, Stamford, Conn.

[21] Appl. No.: 593,790

[22] Filed: Mar. 27, 1984

[51] Int. Cl.[4] ..... H01J 61/33; H01J 61/04

[52] U.S. Cl. ..... 313/634; 313/620; 220/2.1 R

[58] Field of Search ..... 313/634, 639, 620, 621, 313/631, 632; 220/2.1 R; 445/26

[56] References Cited

U.S. PATENT DOCUMENTS

| | | | |
|---|---|---|---|
| 3,898,504 | 8/1975 | Akutsu et al. | 313/620 |
| 4,320,322 | 3/1982 | Rothwell, Jr. et al. | 313/621 |
| 4,321,504 | 3/1982 | Keefe et al. | 313/620 |
| 4,528,478 | 7/1985 | Rothwell, Jr. et al. | 313/631 |

*Primary Examiner*—Palmer C. DeMeo
*Assistant Examiner*—Sandra L. O'Shea
*Attorney, Agent, or Firm*—Jose' W. Jimenez; Thomas H. Buffton

[57] ABSTRACT

A low wattage single-ended metal halide arc discharge lamp has an isothermal arc chamber with an outer diameter (t) substantially equal to the product of a first constant and the lamp wattage plus a second constant; a fill gas and a pair of electrical conductors sealed into and passing through one end of the arc chamber to provide a pair of electrodes therein having a spacing therebetween of about a distance to provide a substantially uniform current for lamps in the range of about 35 to 150 watts.

8 Claims, 6 Drawing Figures

ELECTRODE ALIGNMENT AND CAPSULE DESIGN FOR SINGLE-ENDED LOW WATTAGE METAL HALIDE LAMPS

CROSS REFERENCE TO RELATED APPLICATIONS

The following concurrently filed applications relate to the subject matter of the present application, are assigned to the Assignee of the present application and have the filing date of the present application: Ser. Nos. 593,789 and 593,780, now abandoned.

TECHNICAL FIELD

This invention relates to single-ended low wattage metal halide arc discharge lamps and more particularly to the electrode alignment and arc chamber design of single-ended low wattage metal halide arc discharge lamps.

BACKGROUND ART

Generally, conventional metal halide arc discharge lamps are of the so-called "double-ended" design, as disclosed by Koury in U.S. Pat. No. 3,407,327. Therein, a pair of electrodes are sealed into opposite ends of a fused silica arc tube, an appropriate fill gas is disposed within the arc tube and the arc tube is located within an outer envelope having an attached base member formed for acceptance by a socket. Moreover, commercially available units range from 175 to 1500 watts with an arc gap between the electrodes in the range of 26 to 91 mm and a gap tolerance as great as $\pm 1.0$ mm.

An improvement over the above-described relatively high voltage metal halide arc discharge lamp is set forth in U.S. Pat. No. 4,161,672 issued to Cap et al. Herein, a lamp is disclosed having a power input of about 250-watts and an arc loading of about 60 to 150 watts/cm. However, this structure is again of a "double-ended" variety wherein an electrode is sealed into each end of a longitudinal-extending arc tube. Unfortunately, "double-ended" structures are relatively expensive to manufacture, are not especially suited to an outer envelope with a connecting base at one end due to the double-ended configuration of the arc lamp and tend to exhibit relatively large tolerances in so far as gap spacing and positioning of the electrodes is concerned.

As even greater improvement in the provision of a light source is set forth in the single-ended metal halide arc discharge lamps of U.S. Pat. Nos. 4,302,699; 4,308,483; 4,320,322; 4,321,501 and 4,321,504. All of the above-mentioned patents disclose structures and/or fill gas variations suitable to particular applications. However, each leaves something to be desired insofar as the cost of electrode and arc chamber alignment and tolerances are concerned.

OBJECTS AND SUMMARY OF THE INVENTION

An object of the present invention is to provide an improved single-ended low wattage metal halide arc discharge lamps of varying wattage and a substantially constant current capability. Another object of the invention is to provide an improved metal halide arc discharge lamp having an enhanced isothermal arc chamber. Still another object of the invention is to provide an improved metal halide arc discharge lamp having enhanced alignment of the electrodes therein. A further object of the invention is to provide an enhanced single-ended metal halide arc discharge lamp with an improved isothermal arc chamber and electrode alignment.

These and other objects, advantages, and capabilities are achieved in one aspect of the invention by a single-ended metal halide arc discharge lamp having an isothermal arc chamber with a fill gas therein and a pair of electrical conductors sealed into and passing through one end of the arc chamber to provide a pair of electrodes therein with the outer diameter of the arc chamber determined in accordance with the product of a constant times the lamp wattage plus a second constant.

In another aspect of the invention a single-ended metal halide arc discharge lamp has an isothermal arc chamber with a fill gas therein and a pair of electrical conductors sealed into and passing through one end of the arc chamber to provide a pair of electrodes therein with the electrodes having an arc gap providing a substantially uniform current for lamps in the range of about 35 to 150 watts.

In still another aspect of the invention, a single-ended metal halide arc discharge lamp includes an isothermal arc chamber, a fill gas and a pair of electrodes therein with the arc chamber having an outer diameter varying as a constant times the lamp wattage plus a fixed length and an arc gap of a distance to provide a substantially uniform current for lamps in the range of about 35 to 150 watts.

BEST MODE FOR CARRYING OUT THE INVENTION

For a better understanding of the present invention, together with other and further objects, advantages, and capabilities thereof, reference is made to the following disclosure and appended claims taken in conjunction with the above-described drawings.

Figure 1:
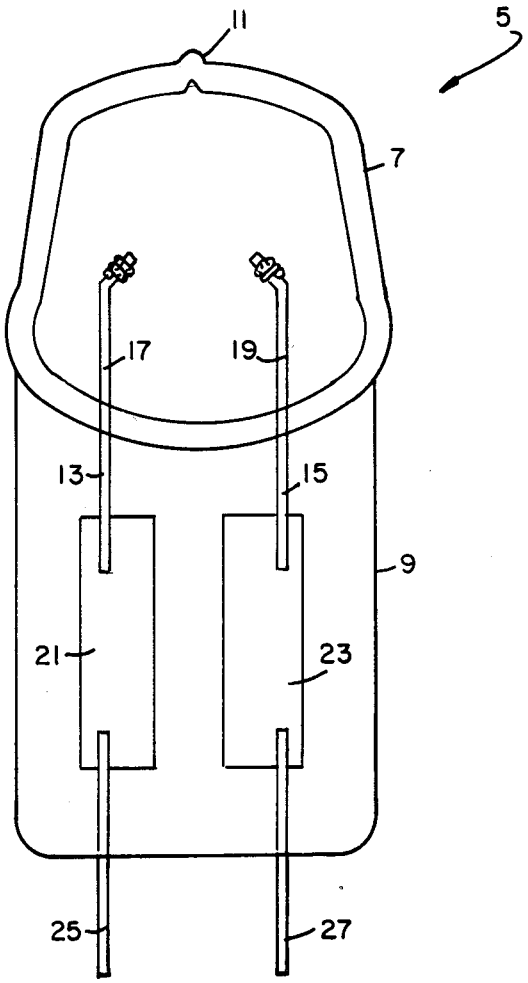
FIG. 1 is a cross-sectional view of a single-ended metal halide arc discharge lamp of the invention.

Referring to FIG. 1 of the drawings, a low wattage single-ended metal halide arc discharge lamp 5 includes an isothermal arc chamber 7 with a press seal portion 9 at one end thereof and an exhaust tip-off seal 11 at the opposite end thereof. A pair of electrical conductors 13 and 15 are sealed into and pass through one end of the arc chamber 7 and form a pair of spaced electrodes 17 and 19 within the arc chamber 7. The electrical conductors 13 and 15 are connected to a pair of metal ribbons 21 and 23 sealed in the press seal portion 9 which are, in turn, connected to a pair of electrical leads 25 and 27 formed for electrical connection to an energizing source.

Figure 2:
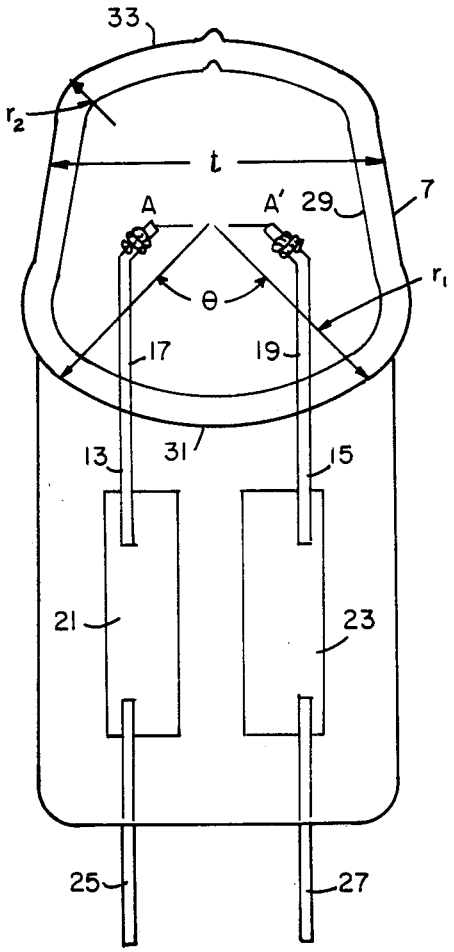
FIG. 2 is a cross-sectional view of a single-ended metal halide arc discharge lamp illustrating the critical dimensions of the arc chamber thereof.

More specifically, the isothermal arc chamber 7 of FIG. 2 has an outer diameter (t), an inner wall portion 29, a press seal seam portion 31 and a dome portion 33. The outer diameter (t) of the arc chamber 7 is determined by the formulation: $t=aW+b$ where W is the lamp wattage; a is substantially equal to $0.07\pm0.01$ mm/watt and b is substantially equal to $7.20\pm1.00$ mm. Thus, the outer diameter (t) of the arc chamber 7 varies in accordance with the lamp wattage employed.

Also, the press seal seam portion 31 has a radius ($r_1$) which is equal to one-half the outer diameter (t) of the arc chamber 7 plus a constant (c) wherein the constant (c) is substantially equal to $1.4\pm0.2$ mm. The dome portion 33 of the arc chamber 7 also has a radius ($r_2$) which is substantially equal to the radius ($r_1$) of the press seal portion 31 divided by a constant (d) wherein (d) is greater than 2.0 mm and less than 4.0 mm. Moreover, the press seal is subtended by an angle $\theta$ having a value of about 115° and centered at the midpoint of a line A—A' joining the ends of the electrodes 17 and 19.

Figure 3:
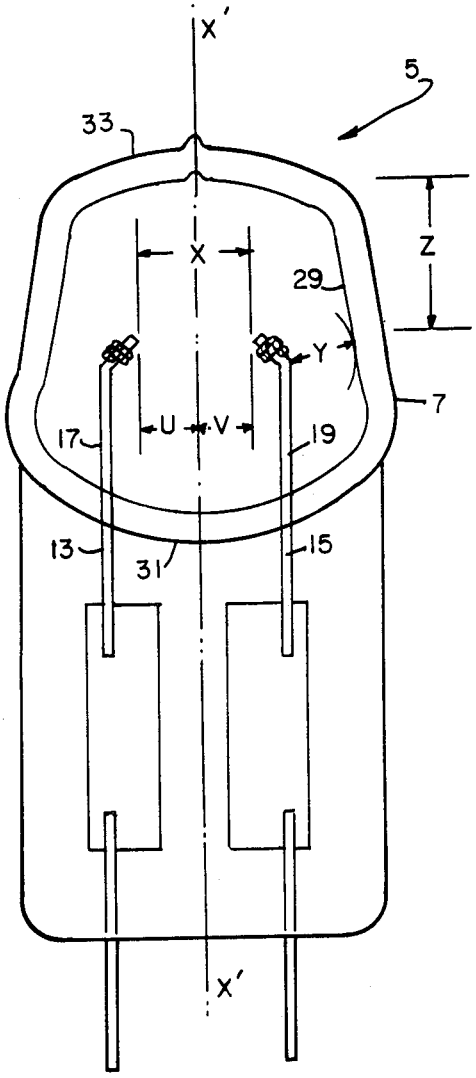
FIG. 3 is a cross-sectional view of a single-ended metal halide arc discharge lamp illustrating the critical dimensions of the electrodes therein.

FIG. 3 illustrates the discharge lamp 5 of FIG. 1 and more particularly the arc chamber 7. The arc chamber 7 has an inner wall portion 29, a press seal seam portion 31 and a dome seal portion 33. A pair of electrical conductors 13 and 15 are sealed into and pass through one end of the arc chamber 7 to provide a pair of electrodes 17 and 19 therein. Each of the electrodes 17 and 19 is spaced from the inner wall portion 29 of the arc chamber 7 by a distance (Y) of not less than about 1.2 mm. Also, the ends of the electrodes 17 and 19 have a gap (X) therebetween of a distance to provide a substantially uniform current for lamps in the range of about 35 to 150 watts, and a deviation or deconcentricity (U—V) of less than about 0.24 mm with respect to a centerline X'—X'. Moreover, the previously-mentioned ends of the electrodes 17 and 19 are spaced from the inner wall surface 29 of the dome seal portion 33 at a distance (Z) of not less than about 3.2 mm and not more than about 3.9 mm.

In fabricating low wattage, normally lamp wattage in the range of about 35 to 150 watts, single-ended metal halide arc discharge lamps, it was determined that a maximum acceptable arc chamber temperature of about 825° C. minimized life limiting mechanisms such as electrode melt back, undesired voltage rise, impaired starting, reduced efficiency, and wall blackening. Also, the utilization of an isothermal arc chamber 7 which substantially eliminated or at least partially reduced such undesired effects as cold spots behind the electrodes and convective flow effects permitted operation of the lamp at or near the above-mentioned maximum acceptable arc chamber temperature.

Also, it has been determined that a substantially uniform current is obtainable for arc discharge lamps in the range of about 35 to 150 watts by controlling the arc gap or spacing the inner ends of the electrodes 17 and 19 within the arc chamber 7. More specifically, it has been found that arc discharge lamps of the above-mentioned wattage range have a substantially uniform current when the arc gap or distance between the inner ends of the electrodes (X) is substantially equal to about $1.74\times10^{-5}W^3-3.3\times10^{-3}W^2+0.267\ W-3.32$ where X is the arc gap or electrode spacing in millimeters and W is the lamp wattage.

Figure 4:
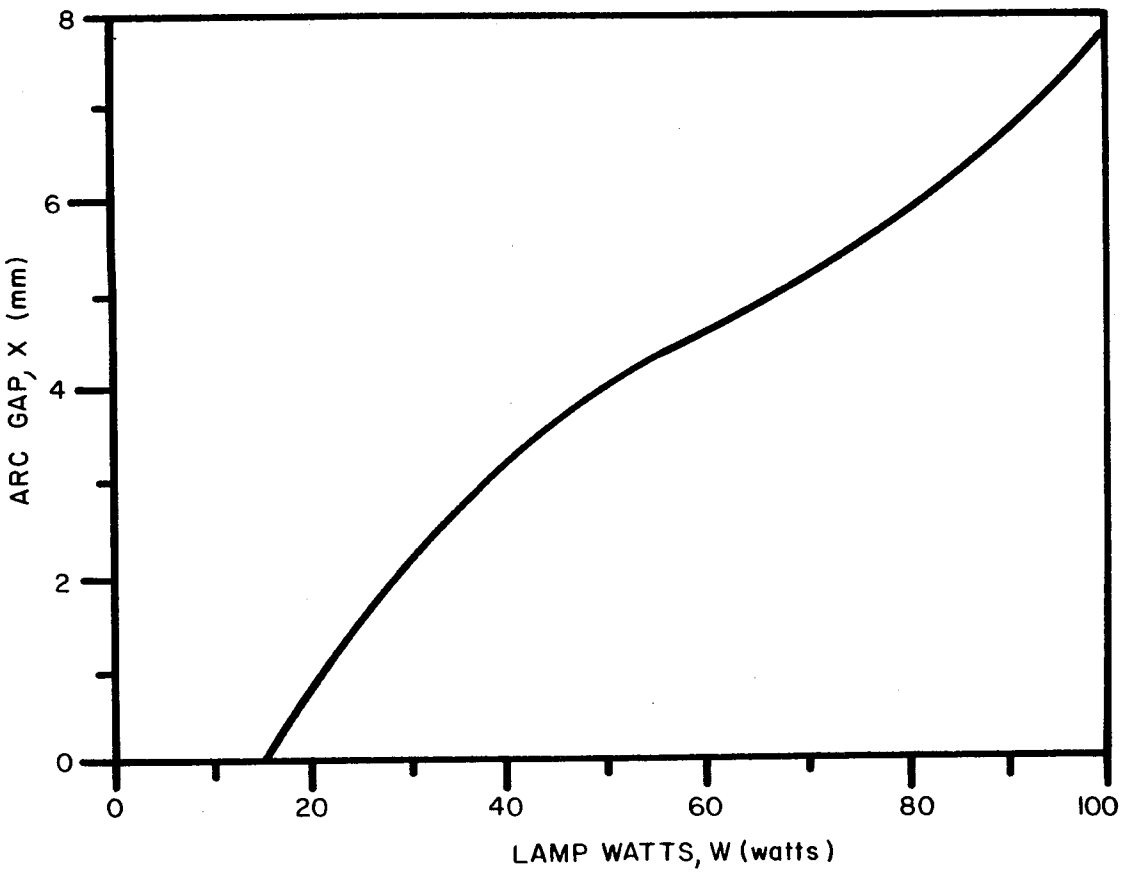
FIG. 4 is a graph illustrating the act gap (x) and wattages of arc discharge lamps operable at a substantially constant current value.

As can clearly be seen in the graph of FIG. 4, the arc gap or distance between the inner ends of the electrodes (X) varies in accordance with variations in the lamp wattage (W). For example, a 40 watt arc discharge lamp would have an arc gap of about 3.2 mm while a 100 watt lamp would have an arc gap of about 7.8 mm and both would have substantially the same electrical current. Accordingly, it can readily be seen that a substantially uniform current permits the interchange of lamps having different wattages without the need for changing the values of the ballast employed. Thus, lamps of varying wattage values, designed in accordance with the presently-described configurations, permit the substitution of varying wattage values without the necessity of alterations in the ballast normally employed for any one of the discharge lamps.

As a specific, but not limiting, example of a preferred embodiment, a 40-watt single-ended miniature metal halide arc tube was constructed having the following configuration:

lamp outer diameter (t)=10.0 mm
press seal portion radius ($r_1$)=6.4 mm
dome seal portion radius ($r_2$)=3.2 mm
press seal subtended angle ($\theta$)=115°

Also, a pair of electrodes 17 and 19 within the arc chamber 7 were spaced about 1.3 mm from the inner wall portion of the arc chamber 7; had an arc gap of about 3.2 mm, a deviation or deconcentricity (U—V) of the electrodes 17 and 19 from center of less than 0.24 mm and were spaced from the dome seal portion 33 by about 3.5 mm.

The lamps had an initial fill gas which included about 7.4 mg Hg; 4.0 mg. 20:1::NaI:$ScI_3$ molar ration; 0.12 mg Sc and 100 torr argon. Upon operation of the lamps at a power loading of about 40-watts in evacuated enclosures, it was found that the arc chamber walls had a temperature varying from a minimum of about 740° C. adjoining the press seal portion 31 to a maximum of about 770° C. in the dome seal portion 33. Thus, the surface temperature of the arc chamber 7 varied by not more than about ±15° C. from the press seal portion 31 to the dome seal portion 33. Moreover, temperatures of the press seal-portion 31 nearest the arc chamber 7 were found to be within a range of about ±5° C.

Figure 5:
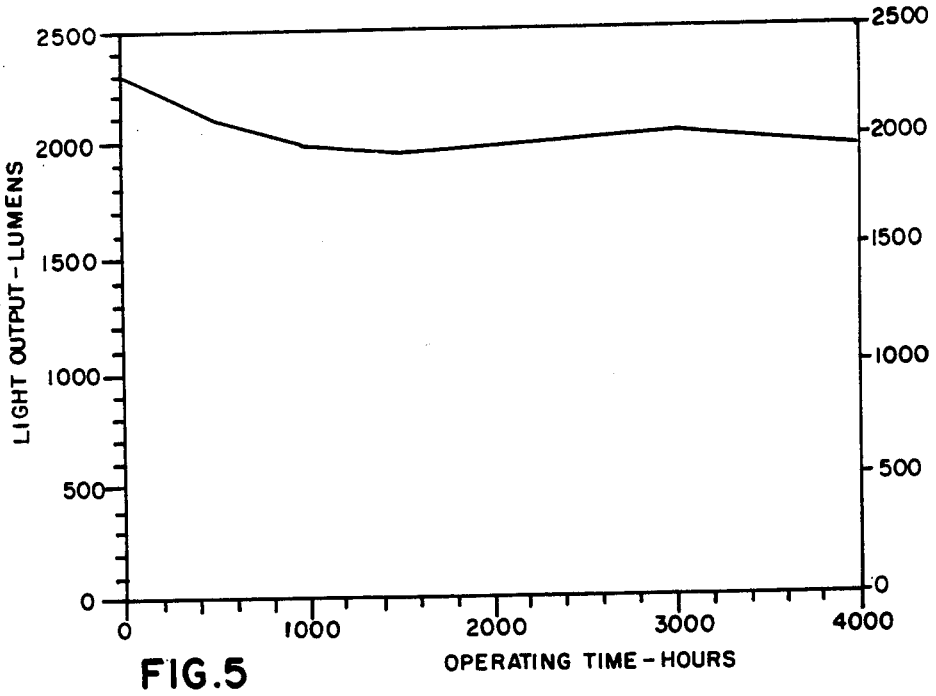
FIG. 5 is a chart illustrating the lumen maintenance performance in accordance with the operating time of a single-ended metal halide arc discharge lamp of the invention.
Figure 6:
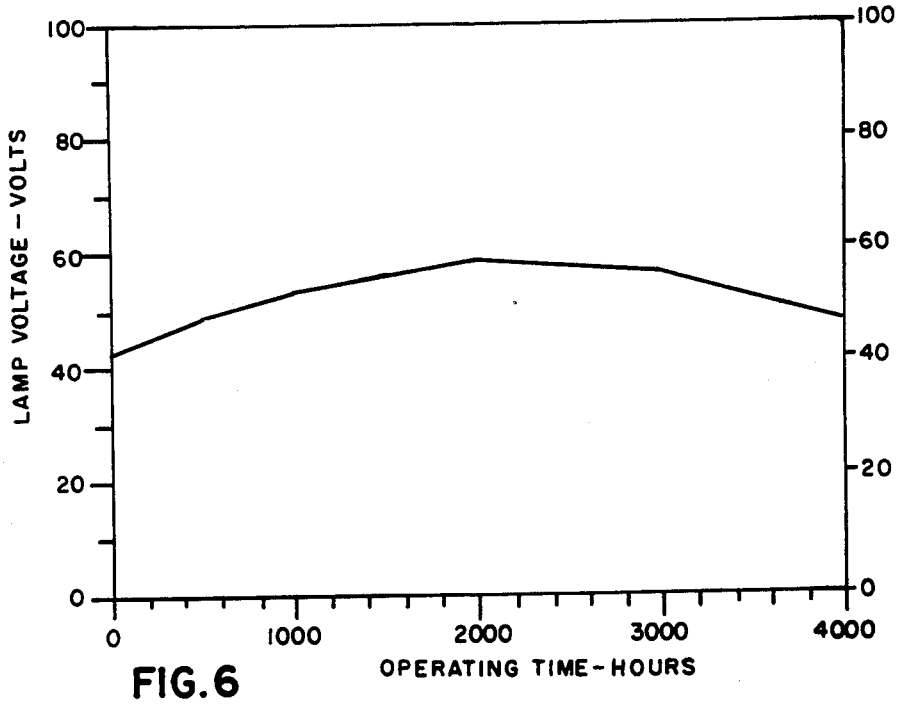
FIG. 6 is a chart illustrating the voltage change in accordance with operating time of the single-ended metal halide arc discharge lamp of the invention.

Accordingly, FIG. 5 illustrates the light output, in lumens, of a plurality of single-ended 40-watt metal halide arc discharge lamps operated for 4000-hours. As can readily be seen, the initial lumen level of about 2300 lumens is maintained at about 1970 lumens or 86% at 4000-hours. Also, FIG. 6 illustrates the lamp voltage of the same group of lamps operating for 4000-hours. Herein, the lamp voltage reaches a peak at about 2000-hours and gradually declines toward the initial starting voltage.

Taken together, the test data supports the realization of a low wattage single-ended metal halide arc discharge lamp wherein life-limiting mechanisms have been reduced. Thus, the isothermal arc chamber design and the electrode alignment with reduced tolerances serve to provide an enhanced low wattage single-ended metal halide arc discharge lamp. Moreover, the attainment of a substantially uniform current conducting capability through proper electrode design permits employment of a single ballast for lamps varying in wattage from about 35 to 150 watts.

While there have been shown what are at present considered to be preferred embodiments of the invention, it will be apparent to those skilled in the art that various changes and modifications can be made herein without departing from the scope of the invention as defined by the appended claims.

We claim:

1. A single-ended low wattage metal halide arc discharge lamp comprising:

an isothermal arc chamber having an outer diameter, a dome seal portion and an inner press seal portion;

a fill gas disposed within said arc chamber which includes mercury, a halide and a starting gas;

a pair of electrical conductors sealed into and passing through one end of said arc chamber to provide a pair of electrodes therein, said arc discharge lamp characterized by the improvement wherein said arc chamber has a diameter as determined in accordance with the following:

$$t=aW+b$$

where:

t=arc chamber outer diameter w=lamp wattage a=0.07±0.01 mm/watt b=7.20±1.00 mm and wherein said press seal portion has a radius ($r_1$) whereat:

$$r_1=t/2+c$$

where:

$$c=1.4\pm0.2\ mm.$$

2. The single-ended low wattage metal halide arc discharge lamp of claim 1 wherein said dome seal portion has an outer radius ($r_2$) whereat:

$$r_2=r_1/d$$

where:

$$r_1=\frac{t}{2}+c$$

$$c=1.4\pm0.2\ \text{mm}$$

$$2<d<4\ \text{mm}.$$

3. The single-ended low wattage metal halide arc discharge lamp of claim 1 wherein said press seal seam portion is contained within a subtended angle $\theta$ substantially equal to about 115°±40° as taken from the midpoint of a line connecting the interior ends of said pair of electrodes.

4. The single-ended low wattage metal halide arc discharge lamp of claim 1 wherein said maximum temperature of said isothermal arc chamber is about 825° C.

5. The single-ended low-wattage metal halide arc discharge lamp of claim 1 wherein said press seal portion has a radius ($r_1$) represented by t/2+c and said dome seal portion has a radius ($r_2$) represented by $r_1/d$ wherein:

$$c=1.4\pm0.2\ \text{mm}$$

$$2<d<4\ \text{mm}$$

6. The single-ended low wattage metal halide arc discharge lamp of claim 1 wherein said low wattage is wattage in the range of about 35 to 150-watts.

7. The single-ended low wattage metal halide arc discharge lamp of claim 1 wherein said isothermal arc chamber has a surface temperature variation of not more than about ±15° C. from said dome seal portion to said press seal seam portion.

8. The single-ended low wattage metal halide arc discharge lamp of claim 1 wherein said press seal seam portion has a temperature variation of not more than about ±5° C.

* * * * *